US007886842B2

(12) United States Patent
Howard et al.

(10) Patent No.: US 7,886,842 B2
(45) Date of Patent: Feb. 15, 2011

(54) APPARATUS AND METHOD FOR ORIENTING A WELLBORE SERVICING TOOL

(75) Inventors: Robert Howard, Duncan, OK (US); Robert Pipkin, Marlow, OK (US); Iosif Hriscu, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 233 days.

(21) Appl. No.: 12/327,600

(22) Filed: Dec. 3, 2008

(65) Prior Publication Data

US 2010/0133012 A1 Jun. 3, 2010

(51) Int. Cl.

| | |
|---|---|
| ***E21B 43/119*** | (2006.01) |
| ***E21B 43/116*** | (2006.01) |
| ***E21B 43/11*** | (2006.01) |
| ***E21B 47/00*** | (2006.01) |

(52) U.S. Cl. ..... 175/4.51; 175/4.56; 166/55; 166/255.2

(58) Field of Classification Search ..... 166/380, 166/382, 242.6, 66.5, 255.2, 297, 55, 308.1, 166/117.7; 175/4.5, 4.51, 4.52, 4.53, 4.54, 175/4.55, 4.56

See application file for complete search history.

(56) References Cited

U.S. PATENT DOCUMENTS

| | | | | |
|---|---|---|---|---|
| 3,273,645 A | | 9/1966 | Der Mott | |
| 4,410,051 A | * | 10/1983 | Daniel et al. | 175/4.51 |
| 4,438,810 A | * | 3/1984 | Wilkinson | 166/66.5 |
| 5,020,591 A | | 6/1991 | Shore | |
| 5,107,927 A | * | 4/1992 | Whiteley et al. | 166/50 |
| 5,259,466 A | * | 11/1993 | Venditto et al. | 175/4.51 |
| 5,273,121 A | * | 12/1993 | Kitney et al. | 175/4.51 |
| 6,213,205 B1 | | 4/2001 | Surjaatmadja | |
| 6,283,208 B1 | * | 9/2001 | George et al. | 166/255.3 |
| 6,336,502 B1 | | 1/2002 | Surjaatmadja et al. | |

(Continued)

FOREIGN PATENT DOCUMENTS

EP 0313374 A1 4/1989

OTHER PUBLICATIONS

Patent application entitled "System and method for lateral wellbore entry, debris removal, and wellbore cleaning," by Jim B. Surjaatmadja, filed Dec. 16, 2009 as U.S. Appl. No. 12/639,244.

(Continued)

*Primary Examiner*—Giovanna C Wright
*Assistant Examiner*—Sonya Bible
(74) *Attorney, Agent, or Firm*—John W. Wustenberg; Conley Rose, P.C.

(57) ABSTRACT

A wellbore servicing apparatus, comprising a first mandrel movable longitudinally along a central axis and rotatable about the central axis, an orienting member configured to selectively interfere with movement of the first mandrel along the central axis, and a second mandrel connected to the first mandrel and configured to rotate about the central axis when the first mandrel rotates about the central axis. A method of orienting a wellbore servicing tool, comprising connecting an orienting tool to the wellbore servicing tool, identifying a predetermined direction, increasing a pressure within the orienting tool, rotating a portion of the orienting tool in response to the increase in pressure within the orienting tool, and rotating the wellbore servicing tool in response to the rotating of the portion of the orienting tool.

22 Claims, 14 Drawing Sheets

U.S. PATENT DOCUMENTS

| | | | |
|---|---|---|---|
| 6,662,874 | B2 | 12/2003 | Surjaatmadja et al. |
| 6,725,933 | B2 | 4/2004 | Middaugh et al. |
| 6,938,690 | B2 | 9/2005 | Surjaatmadja |
| 6,976,507 | B1 | 12/2005 | Webb et al. |
| 7,278,491 | B2 | 10/2007 | Scott |
| 7,404,416 | B2 | 7/2008 | Schultz et al. |
| 7,497,259 | B2 | 3/2009 | Leising et al. |
| 7,617,871 | B2 | 11/2009 | Surjaatmadja et al. |
| 2006/0086507 | A1 | 4/2006 | Surjaatmadja et al. |

OTHER PUBLICATIONS

Patent application entitled "System and method for determining position within a wellbore," by Jim B. Surjaatmadja, et al., filed Feb. 10, 2010 as U.S. Appl. No. 12/703,366.

Patent application entitled "System and method for maintaining position of a wellbore servicing device within a wellbore," by Jim B. Surjaatmadja, filed on May 4, 2010 as U.S. Appl. No. 12/773,481.

Surjaatmadja, Jim B., et al., "An effective sweep-cleaning of large deviated wellbores using small coiled-tubing systems," SPE 94102, 2005, pp. 1-9, Society of Petroleum Engineers.

Nakhwa, A. D., et al., "Oriented perforating using abrasive fluids through coiled tubing," SPE 107061, SPE/ICoTA Coiled Tubing and Well Intervention Conference and Exhibition, The Woodlands, Texas, Mar. 20-21, 2007, pp. 1-7, Society of Petroleum Engineers.

Foreign communication from a related counterpart application—International Search Report and Written Opinion, PCT/GB2009/002808, Aug. 2, 2010, 12 pages.

* cited by examiner

APPARATUS AND METHOD FOR ORIENTING A WELLBORE SERVICING TOOL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations where a fracturing fluid may be introduced into a portion of a subterranean formation penetrated by a wellbore at a hydraulic pressure sufficient to create or enhance at least one fracture therein. Stimulating or treating the wellbore in such ways increases hydrocarbon production from the well. The fracturing equipment, such as a perforating device, may be included in a stimulation assembly used in the overall production process.

In some wells, it may be desirable to create perforation tunnels within a formation. The perforation tunnels typically improve hydrocarbon production by further propagating and creating dominant fractures and micro-fractures so that the greatest possible quantity of hydrocarbons in an oil and/or gas reservoir can be drained/produced into the wellbore. When perforating a formation from a wellbore, or completing the wellbore, especially those wellbores that are highly deviated or horizontal, it may be challenging to control the orientation of tools. Correctly oriented tools facilitate wellbore treatment so that the wellbore can produce effectively. Enhancement in methods and apparatuses to overcome such challenges can further improve hydrocarbon production. Thus, there is an ongoing need to develop new methods and apparatuses for orienting tools used in servicing a wellbore.

SUMMARY

Disclosed herein is a wellbore servicing apparatus, comprising a first mandrel movable longitudinally along a central axis and rotatable about the central axis, an orienting member configured to selectively interfere with movement of the first mandrel along the central axis, and a second mandrel connected to the first mandrel and configured to rotate about the central axis when the first mandrel rotates about the central axis.

Also disclosed herein is a method of orienting a wellbore servicing tool, comprising connecting an orienting tool to the wellbore servicing tool, identifying a predetermined direction, increasing a pressure within the orienting tool, rotating a portion of the orienting tool in response to the increase in pressure within the orienting tool, and rotating the wellbore servicing tool in response to the rotating of the portion of the orienting tool.

Further disclosed herein is a method of servicing a wellbore, comprising connecting an orienting tool to a wellbore servicing tool in a selected relative angular orientation about a central axis, placing the orienting tool and the wellbore servicing tool in the wellbore, identifying a predetermined direction, rotating a portion of the orienting tool about the central axis by an amount dependent upon the relative position of the orienting tool and the predetermined direction, and rotating the wellbore servicing tool in response to the rotation of the portion of the orienting tool.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
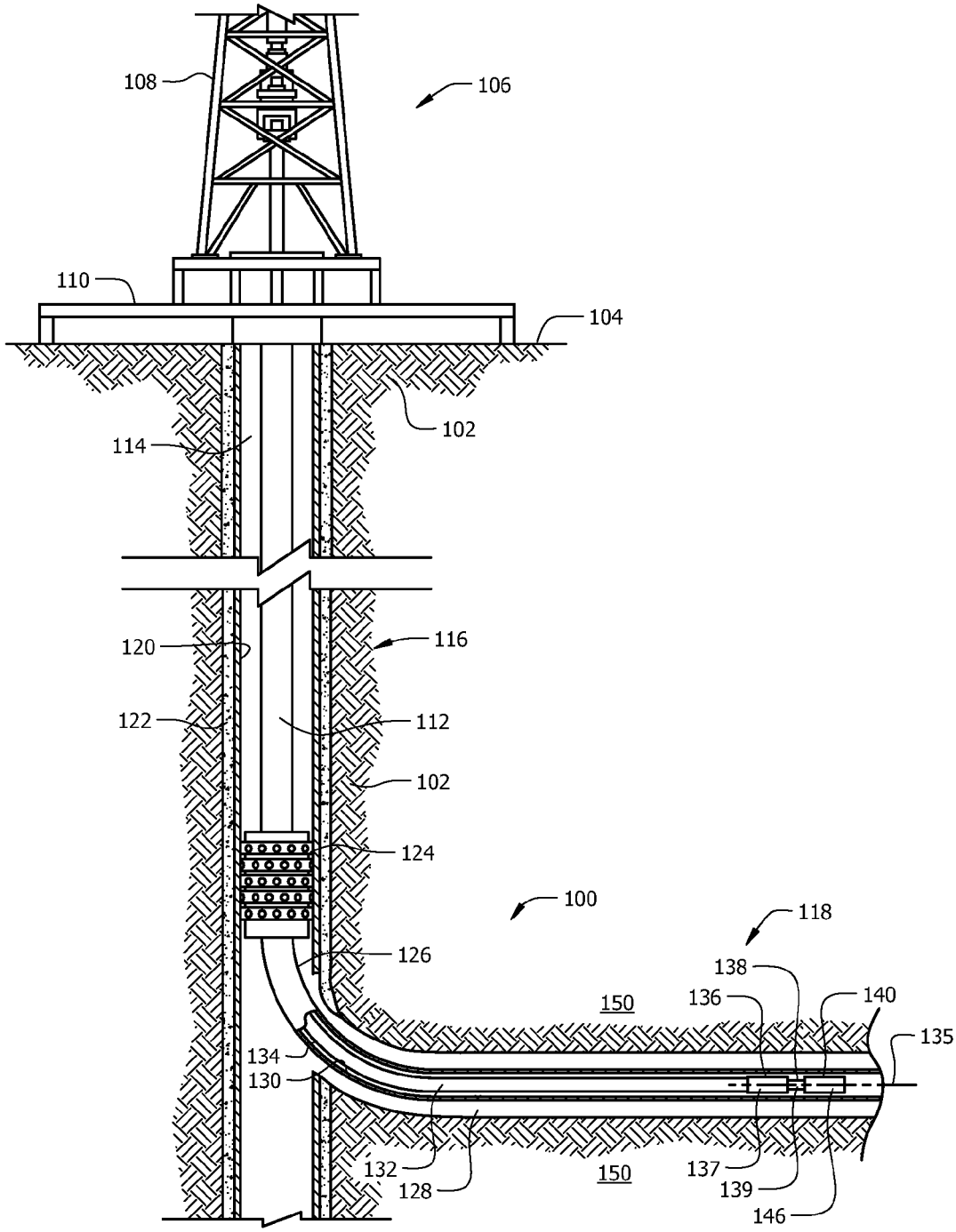
FIG. 1 is a schematic, partial cross-sectional view of an embodiment of a wellbore completion apparatus in an operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Referring to FIG. 1, an embodiment of a wellbore servicing apparatus 100 is shown in an example of an operating environment. As depicted, the operating environment comprises a drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, and deviates at an angle from the earth's surface 104 over a deviated or horizontal wellbore portion 118. In alternative operating environments, all or portions of a wellbore may be vertical, deviated at any suitable angle, horizontal, and/or curved.

At least a portion of the vertical wellbore portion 116 is lined with a casing 120 that is secured into position against the subterranean formation 102 in a conventional manner using cement 122. In alternative operating environments, a horizontal wellbore portion may be cased and cemented and/or portions of the wellbore may be uncased. The drilling rig 106 comprises a derrick 108 with a rig floor 110 through which a tubing or work string 112 (e.g., cable, wireline, E-line, Z-line, jointed pipe, coiled tubing, casing, or liner string, etc.) extends downward from the drilling rig 106 into the wellbore 114. The work string 112 delivers the wellbore servicing apparatus 100 to a selected depth within the wellbore 114 to perform an operation such as perforating the casing 120 and/or subterranean formation 102, creating perforation tunnels and fractures (e.g., dominant fractures, micro-fractures, etc.) within the subterranean formation 102, producing hydrocarbons from the subterranean formation 102, and/or other completion operations. The drilling rig 106 comprises a motor driven winch and other associated equipment for extending the work string 112 into the wellbore 114 to position the wellbore servicing apparatus 100 at the selected depth.

While the example operating environment depicted in FIG. 1 refers to a stationary drilling rig 106 for lowering and setting the wellbore servicing apparatus 100 within a land-based wellbore 114, in alternative embodiments, mobile workover rigs, wellbore servicing units (such as coiled tubing units), and the like may be used to lower a wellbore servicing apparatus into a wellbore. It should be understood that a wellbore servicing apparatus may alternatively be used in other operational environments, such as within an offshore wellbore operational environment.

The wellbore servicing apparatus 100 comprises a liner hanger 124 (such as a Halliburton VersaFlex® liner hanger) and a tubing section 126 extending between the liner hanger 124 and a wellbore lower end. The tubing section 126 comprises a float shoe and a float collar housed therein and near the wellbore lower end. Further, a tubing conveyed device is housed within the tubing section 126 and adjacent the float collar.

The horizontal wellbore portion 118 and the tubing section 126 define an annulus 128 therebetween. The tubing section 126 comprises an interior wall 130 that defines a flow passage 132 therethrough. An inner string 134 is disposed in the flow passage 132 and the inner string 134 extends therethrough so that an inner string lower end extends into and is received by a polished bore receptacle near the wellbore lower end.

An embodiment of an orienting device 136 is housed in the flow passage 132 of the tubing section 126 and is rigidly connected to a perforating device 140 via an adapter 138. The orienting device 136 lies longitudinally along a central axis 135. In this embodiment, the perforating device 140 is a Hydra-Jet® tool, which is available from Halliburton Energy Services, Inc.

The orienting device 136 has an orienting device flowbore 137 that is in fluid communication with the flow passage 132. The adapter 138 has an adapter flowbore 139 that allows fluid communication between the orienting device 136 and the perforating device 140 through the adapter 138. The perforating device 140 has a perforating device flowbore 146 that is in fluid communication with the adapter flowbore 139. In other words, the flow passage 132, the orienting device flowbore 137, the adapter flowbore 139, and the perforating device flowbore 146 are all connected together in fluid communication with each other. The orienting device 136, the adapter 138, and the perforating device 140 are disposed in the horizontal wellbore portion 118 and are associated with a formation zone 150. In alternative embodiments, an orienting device, an adapter, and a perforating device may be disposed in a deviated or vertical wellbore portion and may be associated with multiple formation zones. The orienting device 136 comprises an orienting member, in this embodiment a ball 244 (see FIG. 2), for identifying a selected orientation such as the direction of gravity. In this embodiment, the orienting device 136 comprises the ball 244 for identifying the direction of gravity by identifying a position of lowest gravitational potential energy. However in alternative embodiments, an orienting device may comprise any suitable orienting member such as a ball bearing, a bar, or any other suitable member for identifying a selected orientation (e.g., a position of lowest gravitational potential energy, a position of highest gravitational potential energy, etc.) by using any other suitable means such as using a buoyancy force, a magnetic force, or any other suitable method and/or means. Generally, in operation, after the ball 244 identifies the direction of gravity, the orienting device 136 rotates the perforating device 140 based on the selected orientation relative to the direction of gravity about the central axis 135. Once the perforating device 140 is oriented in the selected orientation, the perforating device 140 creates perforation tunnels having orientation in the selected orientation. The perforation tunnels propagate and further create dominant fractures and micro-fractures to provide flow passages that allow hydrocarbon to reach the wellbore 114. The operation of orienting device 136 is described infra in greater detail.

Figure 2:
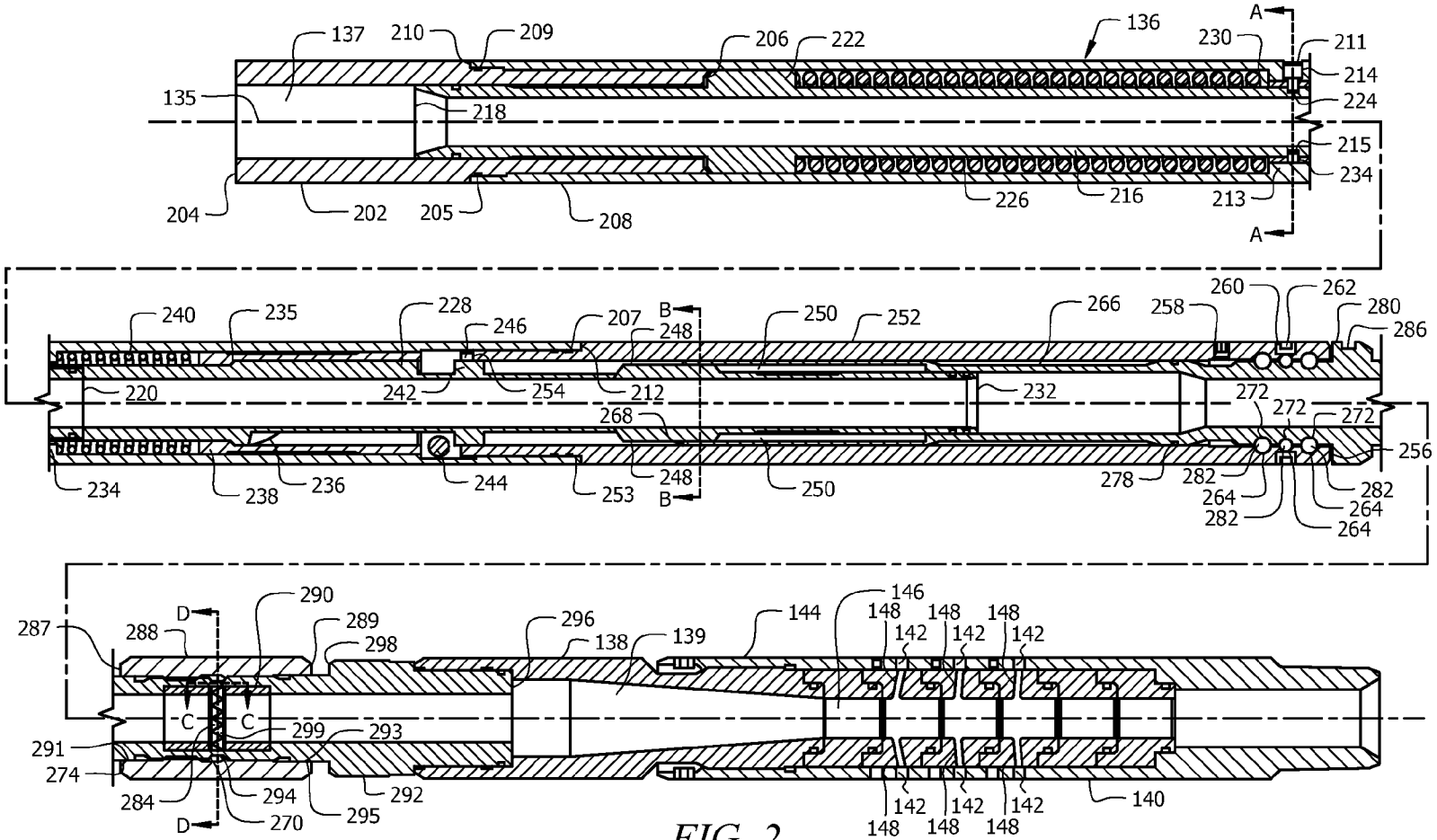
FIG. 2 is a cross-sectional view of an orienting device, an adapter, and a perforating device of the wellbore completion apparatus of FIG. 1.
Figure 3:
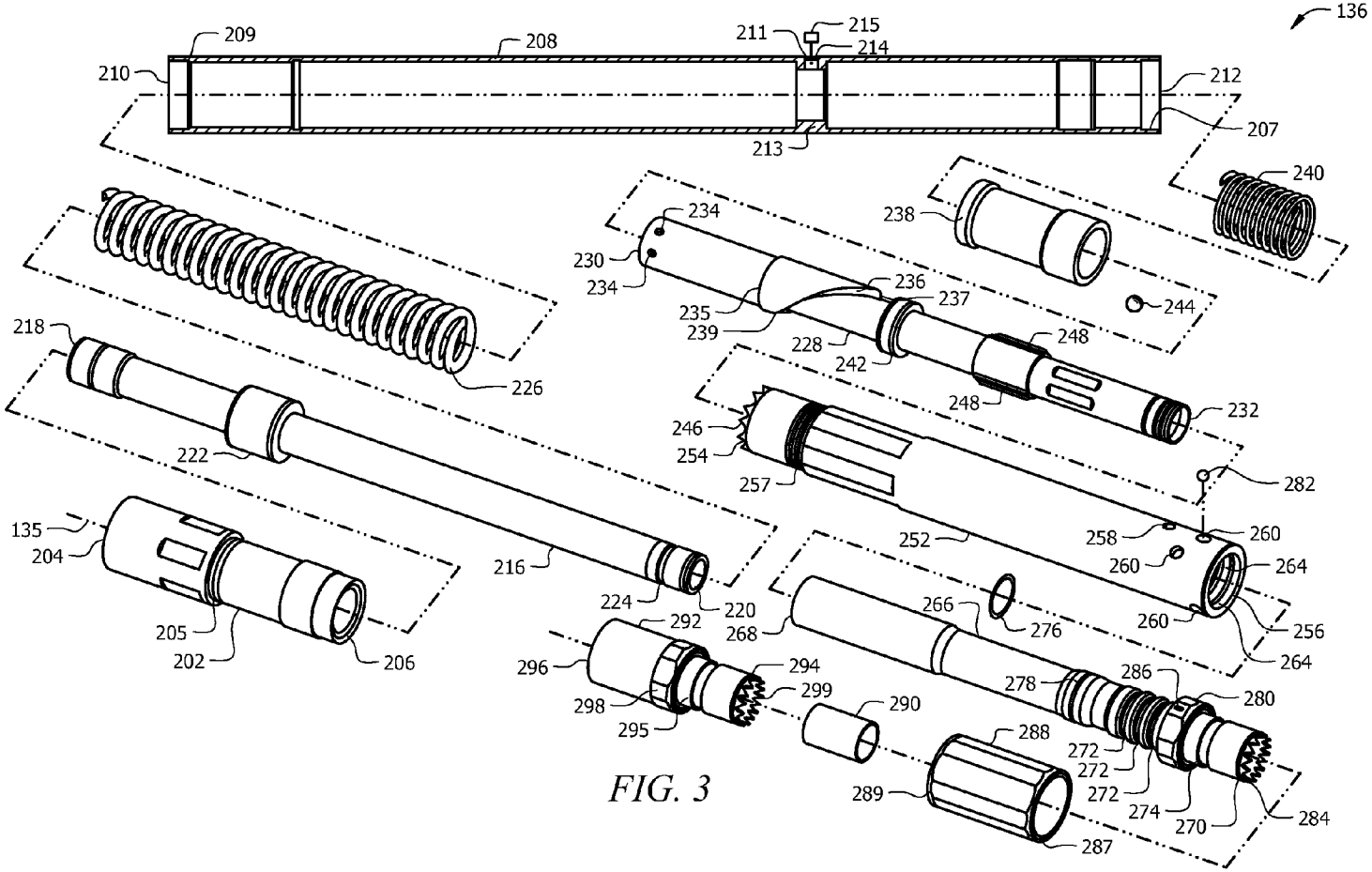
FIG. 3 is an exploded view of the orienting device of FIG. 2.
Figure 8:
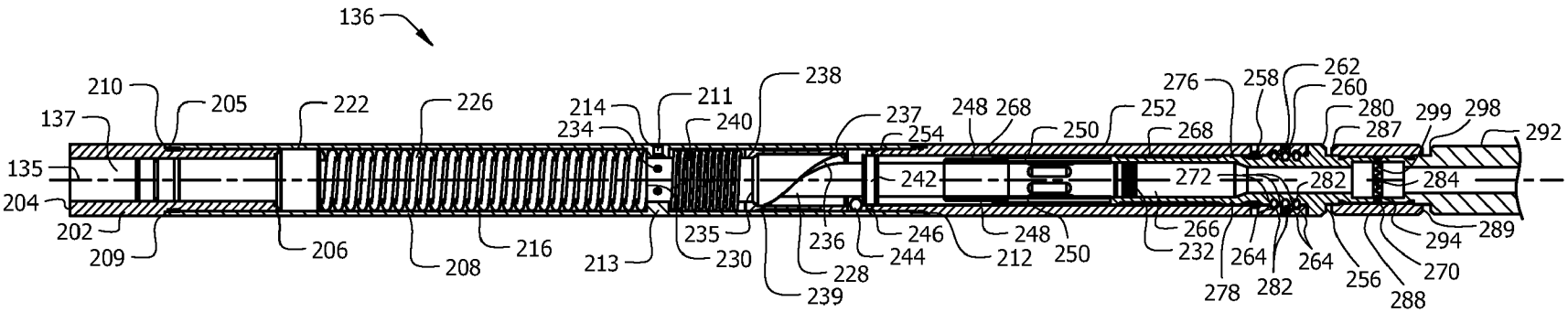
FIG. 8 is an orthogonal cut-away view of the orienting device of FIG. 2.

Referring now to FIG. 2, the orienting device 136 that is connected to the perforating device 140 with the adapter 138 is shown in greater detail. In addition, an exploded view of the orienting device 136 is shown in FIG. 3. The exploded view illustrates the components of the orienting device 136 as discussed infra in FIG. 2. Also, an orthogonal cut-away view of the assembled orienting device 136 is shown in FIG. 8. The orienting device 136 comprises a first sub 202, a piston mandrel 216, a mule shoe mandrel 228, a swivel mandrel 266, a turnbuckle 288, and a second sub 292, each of which lies longitudinally along the central axis 135 and together form the orienting device flowbore 137 that allows fluid communication between the orienting device 136 and the flow passage 132. The orienting device 136 also comprises an upper housing 208 and a lower housing 252 that house the other components of the orienting device 136 as described infra and protect the components of the orienting device 136 from dirt and interference with the interior wall 130.

The first sub 202 is generally tubular in shape and comprises a first sub top 204, a first sub bottom 206, and first sub threads 205. The first sub top 204 is disposed inside the tubing section 126 coaxial with the central axis 135 thereby allowing fluid communication between the orienting device 136 and the flow passage 132. The first sub bottom 206 is carried within the upper housing 208.

The upper housing 208 is also generally tubular in shape and not only houses the lower portion of the first sub 202, but also houses the piston mandrel 216 and the upper portion of the mule shoe mandrel 228. The upper housing 208 comprises an upper housing top 210, an upper housing bottom 212, upper housing upper threads 209, an upper housing inside shoulder 213, and an upper housing aperture 214. An upper housing filter 211 is configured to fit within and complement the upper housing aperture 214. The upper housing filter 211 filters any fluid that flows through the upper housing aperture 214 into the orienting device flowbore 137. Upper housing set screws 215 are inserted through the upper housing aperture 214 into place against the piston mandrel 216 to positionally secure the upper housing 208, the piston mandrel 216, and the mule shoe mandrel 228 relative to each other as described infra.

The piston mandrel 216 is generally tubular in shape and comprises a piston mandrel top 218, a piston mandrel bottom 220, and a piston mandrel shoulder 222. The piston mandrel 216 is connected to the first sub bottom 206 by inserting the piston mandrel top 218 into the first sub bottom 206 so that the piston mandrel shoulder 222 contacts the first sub bottom 206. A piston mandrel groove 224 is positioned near the piston mandrel bottom 220 and is used for receiving the upper housing set screws 215 to connect the piston mandrel 216, the mule shoe mandrel 228, and the upper housing 208. The piston mandrel 216 is connected to the mule shoe mandrel 228 so that the piston mandrel 216 is prevented from moving longitudinally along the central axis 135 or rotationally about the central axis 135 with respect to the mule shoe mandrel 228. Both the piston mandrel 216 and an upper portion of the mule shoe mandrel 228 are housed coaxially within the upper housing 208 along the central axis 135. The upper housing set screws 215 are inserted individually from the upper housing aperture 214 through the mule shoe mandrel apertures 234 until the upper housing set screws 215 contact the piston mandrel groove 224. In this embodiment, there are six upper housing set screws 215, six mule shoe mandrel apertures 234, and only one upper housing aperture 214. The assembly of the upper housing set screws 215 from the upper housing aperture 214 and through the mule shoe mandrel apertures 234 is described infra.

A compressible piston spring 226 is positioned coaxial with the central axis 135 and is located between the piston mandrel 216 and the upper housing 208, around the piston mandrel 216, in a space between the piston mandrel shoulder 222 and the upper housing inside shoulder 213.

The mule shoe mandrel 228 is generally tubular in shape and comprises a mule shoe mandrel top 230, a mule shoe mandrel bottom 232, mule shoe mandrel apertures 234, a mule shoe mandrel shoulder 242, two mule shoe mandrel wings 248, and a tapered mule shoe 236 that has a tapered mule shoe top 235, a tapered mule shoe bottom 237 (shown in FIG. 3), and a tapered mule shoe peak 239 (shown in FIG. 3). Returning to FIG. 2, a compressible sliding sleeve spring 240 is positioned coaxial with the central axis 135 around the mule shoe mandrel 228 between the upper housing inside shoulder 213 and the tapered mule shoe top 235. A sliding sleeve 238 is positioned coaxial with the central axis 135 and around the tapered mule shoe 236 between the sliding sleeve spring 240 and the ball 244.

The lower portion of the mule shoe mandrel 228 and the upper portion of the swivel mandrel 266 are housed within the lower housing 252. The lower housing 252 is generally tubular in shape and comprises a lower housing top 254, a lower housing bottom 256, ball notches 246, a lower housing grease port 258, lower housing swivel apertures 260, and lower housing swivel tracks 264. The ball notches 246 are positioned along the tip of the lower housing top 254 and are configured to receive and engage the ball 244. The ball 244 has a diameter of about 0.5625 inches. However, in alternative embodiments, a ball may have a larger or smaller diameter than about 0.5625 inches. For example, in one alternative embodiment, a ball may have a diameter of about 0.50 inches. The ball 244 is positioned within a space defined between the tapered mule shoe 236, the sliding sleeve 238, the mule shoe mandrel shoulder 242, the upper housing 208, and the ball notches 246. Further, the position of the ball 244 is not substantially influenced by fluid pressure within the space surrounding the ball 244, but rather, is primarily influenced by the effect of gravity acting on the ball 244 as explained infra. During operation, the ball 244 is received within and is engaged with one of the ball notches 246 as described infra. The mule shoe mandrel 228 has two mule shoe mandrel wings 248 and the swivel mandrel 266 has two swivel mandrel wing channels 250. The mule shoe mandrel wings 248 are shaped to complement the swivel mandrel wing channels 250 so that the mule shoe mandrel wings 248 can transfer the rotation of the tapered mule shoe 236 about the central axis 135 to the swivel mandrel 266. Lower housing set screws 262 are inserted into the lower housing swivel apertures 260 to keep the plurality of swivel mandrel swivel balls 282 in their designated position, as described infra.

The swivel mandrel 266 is generally tubular in shape and comprises a swivel mandrel top 268, a swivel mandrel bottom 270, swivel mandrel swivel tracks 272, a swivel mandrel o-ring groove 278, a swivel mandrel flange 280, swivel mandrel teeth 284, and a swivel mandrel visual indicator 286. A plurality of swivel mandrel swivel balls 282 are captured between the lower housing swivel tracks 264 and the swivel mandrel swivel tracks 272, allowing the swivel mandrel 266 to rotate inside the lower housing 252. In other words, the swivel mandrel 266 is configured to rotate about the central axis 135 within the lower housing 252 relative to the lower housing 252. A swivel mandrel o-ring 276 is seated on the swivel mandrel o-ring groove 278 to provide a seal between the swivel mandrel 266 and the lower housing 252. The swivel mandrel visual indicator 286 is positioned on the swivel mandrel flange 280 for aligning the perforating device 140 with respect to the orienting device 136.

The lower housing grease port 258 provides a fluid path to the swivel mandrel swivel tracks 272 and the lower housing swivel tracks 264. The lower housing grease port 258 is used as a passage for inserting oil, lubricant, etc. into the space between the swivel mandrel swivel tracks 272 and the lower housing swivel tracks 264 to lubricate the swivel mandrel swivel balls 282, the swivel mandrel swivel tracks 272, and the lower housing swivel tracks 264, thereby reducing friction therebetween. The swivel mandrel o-ring 276 is seated in the swivel mandrel o-ring groove 278, thereby providing a seal between the lower housing 252 and the swivel mandrel 266 so that unwanted fluid may not enter the orienting device 136 while still allowing the swivel mandrel 266 to rotate within the lower housing 252 relative to the lower housing 252. The swivel mandrel 266 further comprises swivel mandrel teeth 284 positioned along the free end of the swivel mandrel bottom 270. The swivel mandrel 266 further comprises swivel mandrel threads 274 located below the swivel mandrel flange 280 that are used to tighten the connection between the swivel mandrel 266 and the second sub 292 by using the turnbuckle 288 as described infra.

The second sub 292 is generally tubular in shape and comprises a second sub top 294, a second sub bottom 296, and a second sub flange 298. The second sub 292 further comprises second sub teeth 299 positioned along the free end of the second sub top 294. The second sub 292 further comprises second sub threads 295 located above the second sub flange 298 that are used to tighten the connection between the swivel mandrel 266 and the second sub 292 by using the turnbuckle 288, as described infra.

The turnbuckle 288 is generally tubular in shape and comprises a turnbuckle top 287 and a turnbuckle bottom 289. A turnbuckle inner sleeve 290 is positioned coaxial with the second sub top 294 and the swivel mandrel bottom 270. The turnbuckle 288 further comprises two sets of threads, upper turnbuckle threads 291 and lower turnbuckle threads 293, with different pitches, the upper turnbuckle threads 291 complementing the swivel mandrel threads 274 and the lower turnbuckle threads 293 complementing the second sub threads 295, which are used to tighten the connection between the swivel mandrel 266 and the second sub 292 as described infra. In this embodiment, the swivel mandrel threads 274 have 6 threads per inch and the second sub threads 295 have 12 threads per inch. To tighten the connection between the swivel mandrel 266 and the second sub 292, the turnbuckle bottom 289 is first threaded onto the second sub top 294. Next, the turnbuckle top 287 is threaded onto the swivel mandrel bottom 270, while at the same time the turnbuckle bottom 289 is threaded off of the second sub top 294 half the distance that the swivel mandrel bottom 270 moves relative to the turnbuckle 288. In other words, for every inch the swivel mandrel 266 is threaded into to the turnbuckle 288, the second sub 292 is threaded out of the turnbuckle 288 by one half of an inch. In that way, the swivel mandrel 266 and the second sub 292 are tightened to each other.

The second sub bottom 296 is rigidly connected to the adapter 138 along the central axis 135 so that the adapter flowbore 139 is in fluid communication with the orienting device flowbore 137. The adapter 138 is then rigidly connected to the perforating device 140 along the central axis 135 so that the perforating device flowbore 146 is in fluid communication with the adapter flowbore 139. The perforating device 140 comprises a plurality of jet forming nozzles 148 and a perforating device housing 144. The perforating device flowbore 146 is in fluid communication with the adapter flowbore 139. The perforating device housing 144 protects the nozzles 148 from becoming clogged with debris. The perforating device housing 144 also comprises a plurality of perforating device apertures 142 that allow fluid communication between the nozzles 148 and the space exterior to the perforating device housing 144.

The steps to assemble the orienting device 136 of FIGS. 2 and 3 are discussed here in greater detail. First, the piston spring 226 is inserted into the upper housing 208 from the upper housing top 210. Next, the piston mandrel 216 is inserted into the upper housing 208 from the upper housing top 210. The first sub 202 is connected to the upper housing 208 by inserting the first sub bottom 206 into the upper housing top 210 and threading the first sub threads 205 into the upper housing upper threads 209 until the piston spring 226 is slightly compressed between the piston mandrel shoulder 222 and the upper housing inside shoulder 213.

Next, the ball 244 is placed against the mule shoe mandrel 228 between the mule shoe mandrel shoulder 242 and the tapered mule shoe 236. The sliding sleeve 238 is then assembled coaxially around the mule shoe mandrel top 230. The sliding sleeve 238 is then moved toward the mule shoe mandrel shoulder 242 until the sliding sleeve 238 captures the ball 244 between the sliding sleeve 238 and the mule shoe mandrel shoulder 242. Next, the sliding sleeve spring 240 is assembled coaxially around the mule shoe mandrel top 230. The sliding sleeve spring 240 is then moved until the sliding sleeve spring 240 contacts the sliding sleeve 238. Next, the swivel mandrel o-ring 276 is seated on the swivel mandrel o-ring groove 278.

Next, the mule shoe mandrel 228, with the sliding sleeve 238 and sliding sleeve spring 240 assembled thereon, and carrying the ball 244 is inserted into the upper housing bottom 212 so that the upper housing aperture 214 aligns with one of the mule shoe mandrel apertures 234 and the piston mandrel groove 224. Next, upper housing set screws 215 are inserted from the upper housing aperture 214, through the mule shoe mandrel apertures 234 and into the piston mandrel groove 224 to hold the piston mandrel 216 and the mule shoe mandrel 228 together inside the upper housing 208.

Figure 4:
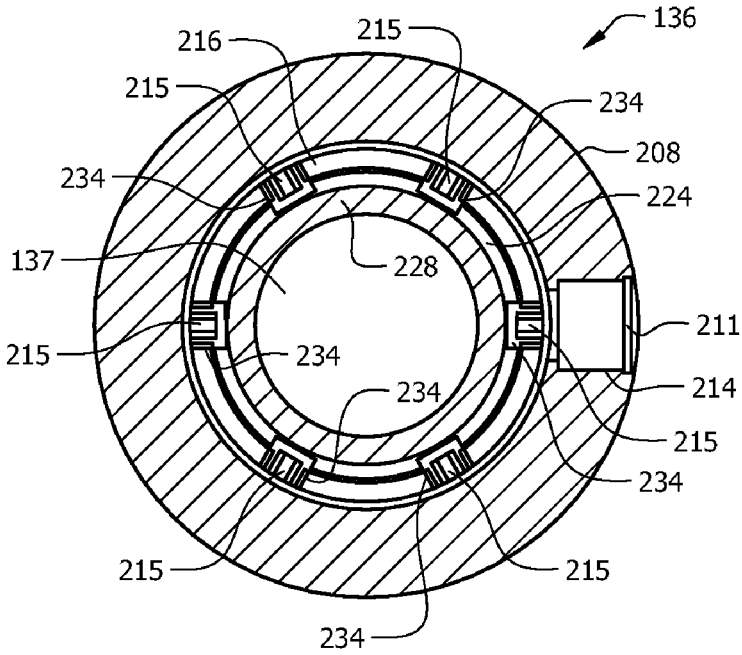
FIG. 4 is an orthogonal cross-sectional view of the orienting device of FIG. 2 taken at line A-A of FIG. 2.

More specifically, the upper housing aperture 214 is first aligned with one of the mule shoe mandrel apertures 234. Next, the first upper housing set screw 215 is inserted through the upper housing aperture 214, to the mule shoe mandrel apertures 234, until the first upper housing set screw 215 contacts the piston mandrel groove 224. Next, the upper housing aperture 214 is rotated about the central axis 135 and aligned with another one of the mule shoe mandrel apertures 234. A second upper housing set screw 215 is then inserted through the upper housing aperture 214, to the mule shoe mandrel aperture 234, until the second upper housing set screw 215 contacts the piston mandrel groove 224. Each of the remaining upper housing set screws 215 are inserted subsequently as described previously so that each of the upper housing set screws 215 are inserted through the mule shoe mandrel aperture 234. FIG. 4 is an orthogonal cross-sectional view taken at line A-A of FIG. 2, and further illustrates the connection between the upper housing aperture 214 of the upper housing 208, the upper housing set screws 215, the mule shoe mandrel apertures 234 of the mule shoe mandrel 228, and the piston mandrel groove 224 of the piston mandrel 216.

Returning to FIG. 3, the lower housing 252 is connected to the upper housing 208 by inserting the lower housing top 254 into the upper housing bottom 212 so that upper housing lower threads 207 engage lower housing threads 253. In this position, the lower portion of the mule shoe mandrel 228 is positioned coaxial with the central axis 135 inside the lower housing 252 of FIG. 2.

Figure 5:
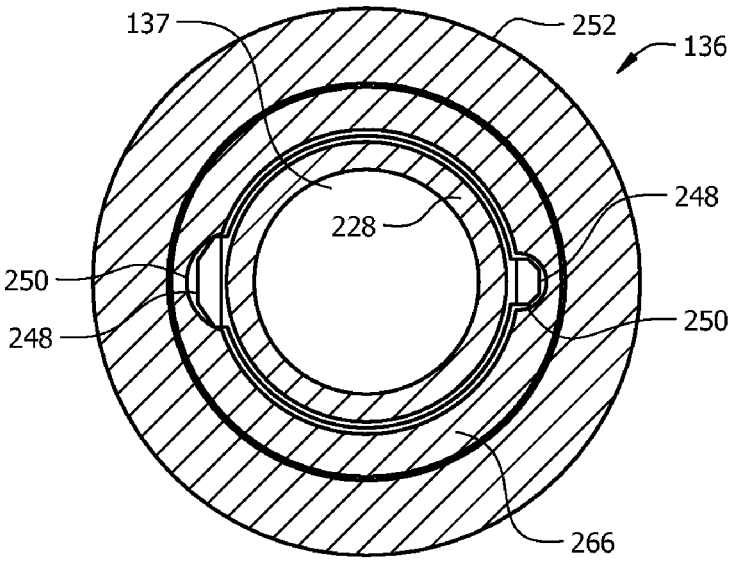
FIG. 5 is an orthogonal cross-sectional view of the orienting device of FIG. 2 taken at line B-B of FIG. 2.

Continuing with the assembly of the orienting device 136 shown in FIG. 3, the swivel mandrel 266 is inserted into the bottom of the lower housing 252 until the swivel mandrel flange 280 contacts the lower housing bottom 256. FIG. 5 is an orthogonal cross-sectional view taken at line B-B of FIG. 2, which illustrates the connection between the mule shoe mandrel wings 248 of the mule shoe mandrel 228 and the swivel mandrel wing channels 250 of the swivel mandrel 266, all of which are coaxially positioned inside the lower housing 252.

Returning to FIG. 3, swivel mandrel swivel balls 282 are inserted from the lower housing swivel apertures 260 and are captured between the lower housing swivel tracks 264 and the swivel mandrel swivel tracks 272. Lower housing set screws 262 are then inserted into the lower housing swivel apertures 260 to prevent the swivel mandrel swivel balls 282 from exiting the lower housing swivel apertures 260 and to keep the swivel mandrel swivel balls 282 between the lower housing swivel tracks 264 and the swivel mandrel swivel tracks 272. The lower housing grease port 258 is opened and oil/grease/lubricant is inserted from the lower housing grease port 258 to lubricate the swivel mandrel swivel balls 282, the lower housing swivel tracks 264, and the swivel mandrel swivel tracks 272 in order to reduce friction therebetween.

Figure 6:
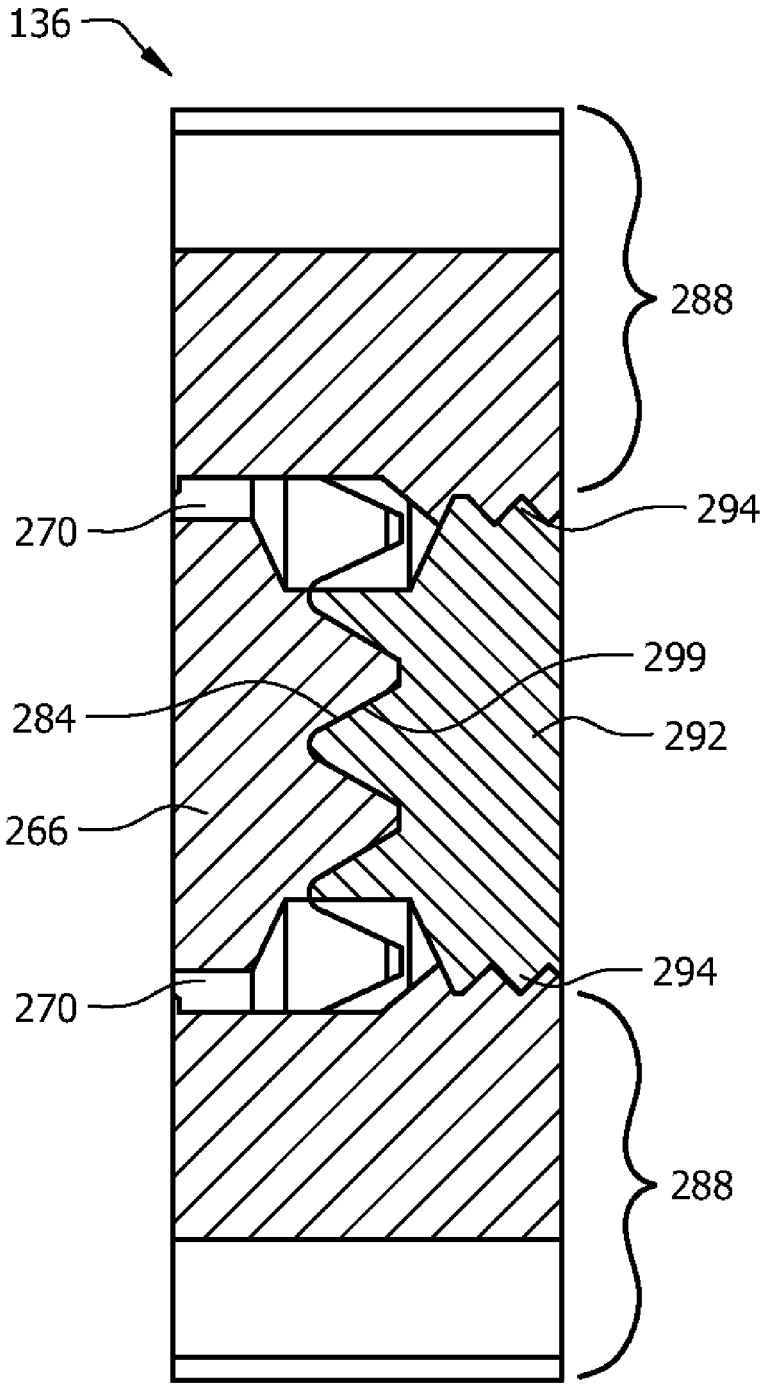
FIG. 6 is a partial orthogonal cross-sectional view of the orienting device of FIG. 2 taken at line C-C of FIG. 2.
Figure 7:
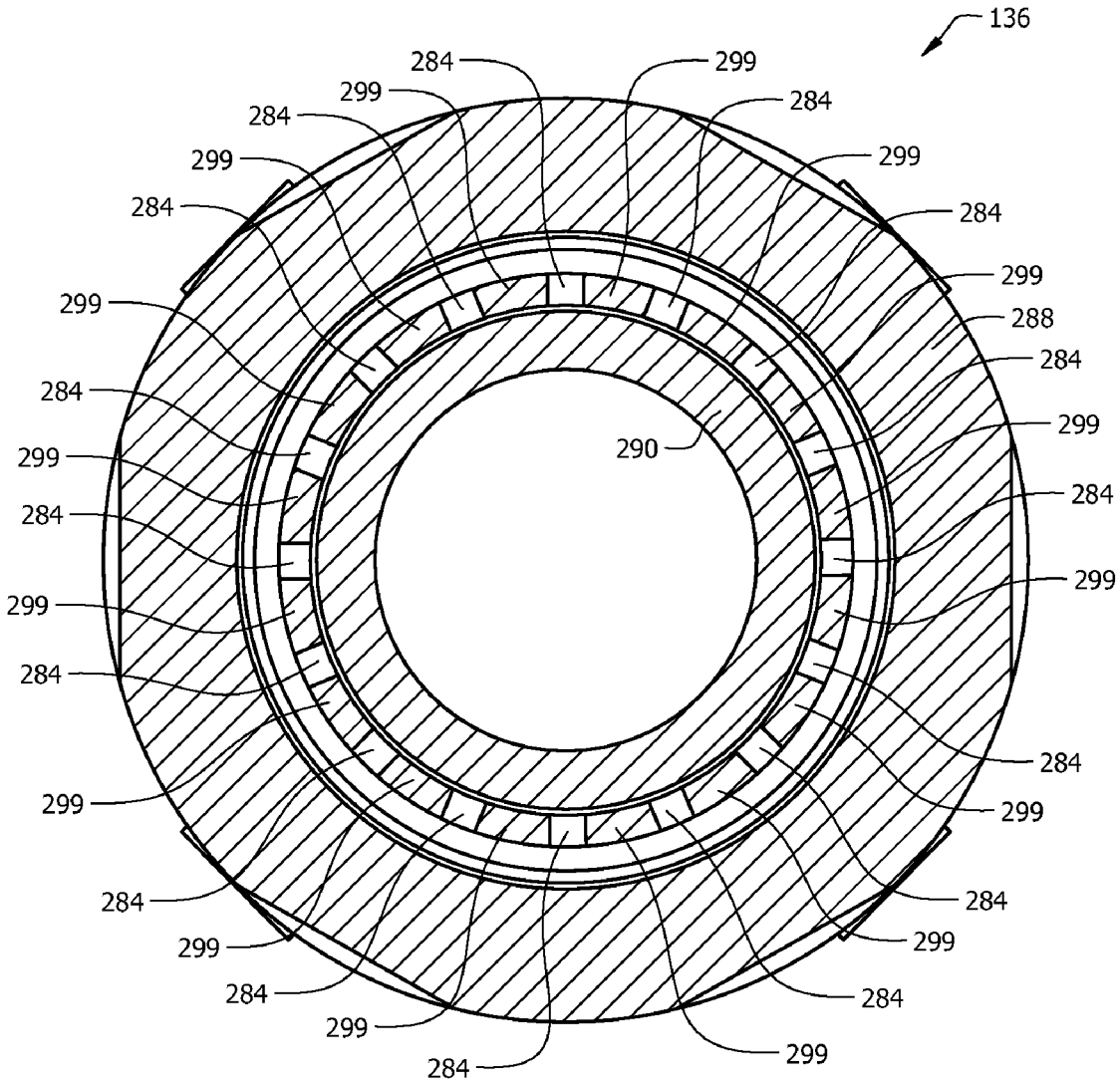
FIG. 7 is an orthogonal cross-sectional view of the orienting device of FIG. 2 taken at line D-D of FIG. 2.

Next, the second sub bottom 296 is connected to the perforating device 140 as shown in FIG. 2 (or other tool to be oriented) using any suitable adapter. Returning to FIG. 3, the turnbuckle bottom 289 is then threaded onto the second sub top 294 until the turnbuckle 288 contacts the second sub flange 298. The turnbuckle inner sleeve 290 is then assembled within either into the second sub top 294 or the swivel mandrel bottom 270. Next, the perforating device 140 is rotated about the central axis 135 to align the perforating device apertures 142 with the swivel mandrel visual indicator 286, as shown in FIG. 2. Returning to FIG. 3, the turnbuckle top 287 is screwed onto the swivel mandrel bottom 270 which necessarily unscrews the second sub top 294 from the turnbuckle 288 until the swivel mandrel teeth 284 are tightened against the second sub teeth 299. FIG. 6 is a partial orthogonal cross-sectional view of the orienting device 136 taken at line C-C of FIG. 2, and illustrates the connection between the swivel mandrel teeth 284 that are engaged with the second sub teeth 299. Because the swivel mandrel bottom 270 has coarser thread pitch (i.e., 6 threads per inch) than the finer thread pitch of the second sub top 294 (i.e., 12 threads per inch), for each rotation of the turnbuckle 288 the swivel mandrel 266 screws into the turnbuckle 288 at twice the distance the second sub 292 screws out of the turnbuckle 288 so that the swivel mandrel 266 and the second sub 292 pull closer together until the swivel mandrel teeth 284 engage and/or are tightened against the second sub teeth 299. FIG. 7 is an orthogonal cross-sectional view taken at line D-D of FIG. 2, and illustrates the connection between the swivel mandrel teeth 284 that is engaged with the second sub teeth 299. Note that typically, the turnbuckle 288, the second sub 292, and the perforating device 140 (or other tool to be oriented) are assembled and connected to the preassembled swivel mandrel 266 at the well site.

Figure 9:
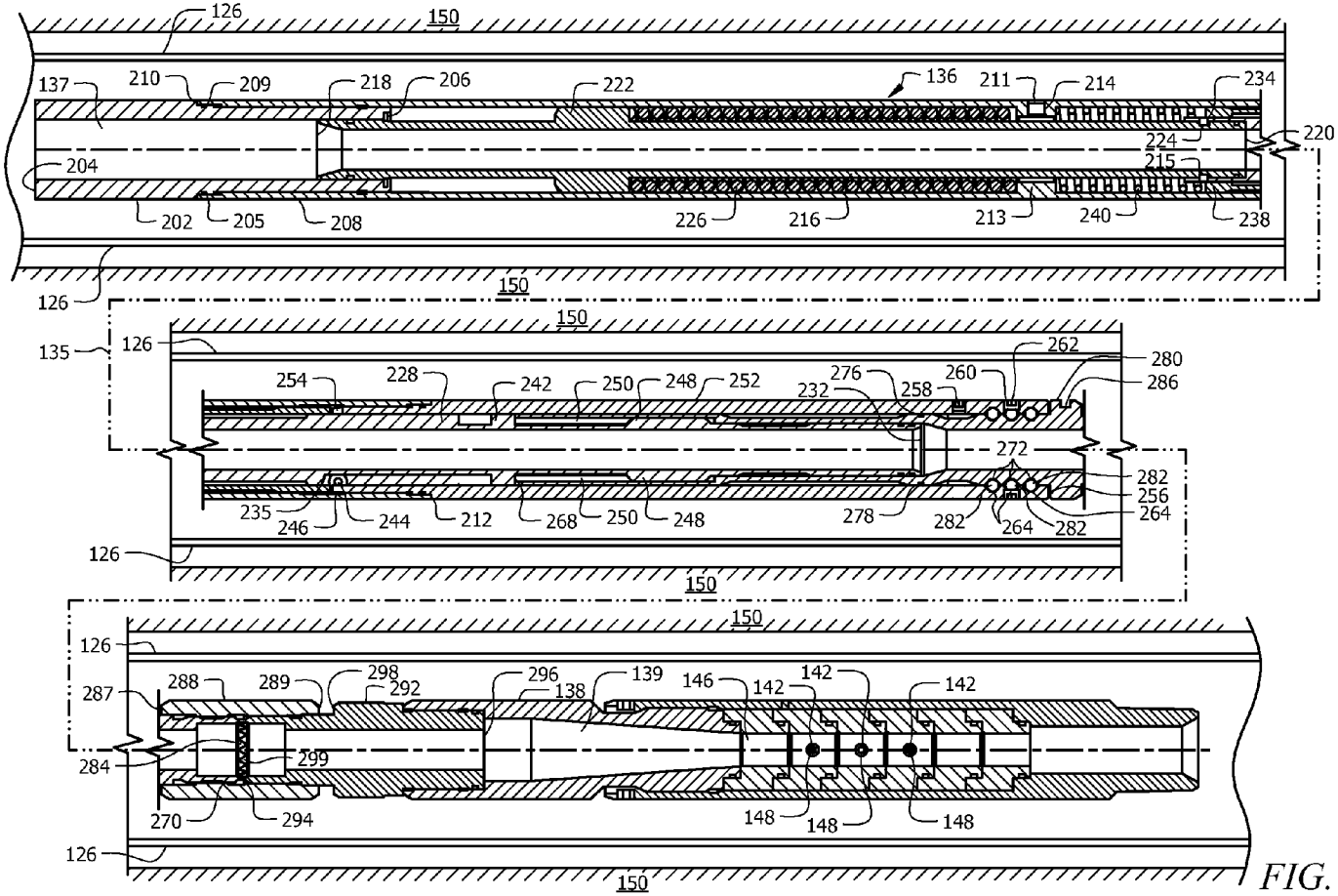
FIG. 9 is an orthogonal cross-sectional view of the orienting device, the adapter, and the perforating device of FIG. 2 at the beginning of a wellbore servicing operation.

The steps of one embodiment of a method of operating the orienting device 136 to service the wellbore 114 are shown in FIGS. 1 and 9-14. FIG. 9 is a cross-sectional view of the orienting device 136 connected to the perforating device 140 at the beginning of a wellbore servicing operation within the horizontal wellbore portion 118. Initially, the orienting device 136 is in a relaxed position while the perforating device 140 is in an undesirable orientation wherein the nozzles 148 and the perforating device apertures 142 are perpendicular to the direction of gravity instead of parallel to or in the direction of gravity.

As shown in FIG. 1, the wellbore servicing method begins by disposing a liner hanger 124 comprising a float shoe, a float collar, and a tubing section 126. The tubing section 126 comprises an orienting device 136 connected to a perforating device 140 via an adapter 138. The float shoe and float collar are disposed near the toe of the wellbore 114. In this embodiment, the orienting device 136, the adapter 138, and the perforating device 140 are positioned in the horizontal wellbore portion 118 near formation zone 150; however, in alternative embodiments, an orienting device, an adapter, and a perforating device may be positioned in a deviated, or a vertical wellbore portion. Additionally, servicing a wellbore may alternatively be carried out for a plurality of formation zones starting from a formation zone in the furthest or lowermost end of the wellbore (i.e., toe) and sequentially backward toward the closest or uppermost end of the wellbore (i.e., heel).

When the orienting device 136, the adapter 138, and the perforating device 140 are positioned in the horizontal wellbore portion 118 near formation zone 150, the ball 244 identifies the direction of gravity by moving to the position of lowest gravitational potential energy. It will be appreciated that in alternative embodiments of wellbore servicing methods, other suitable methods may be used to identify the direction of gravity, for example by buoyancy force, by magnetic force, etc.

Figure 10:
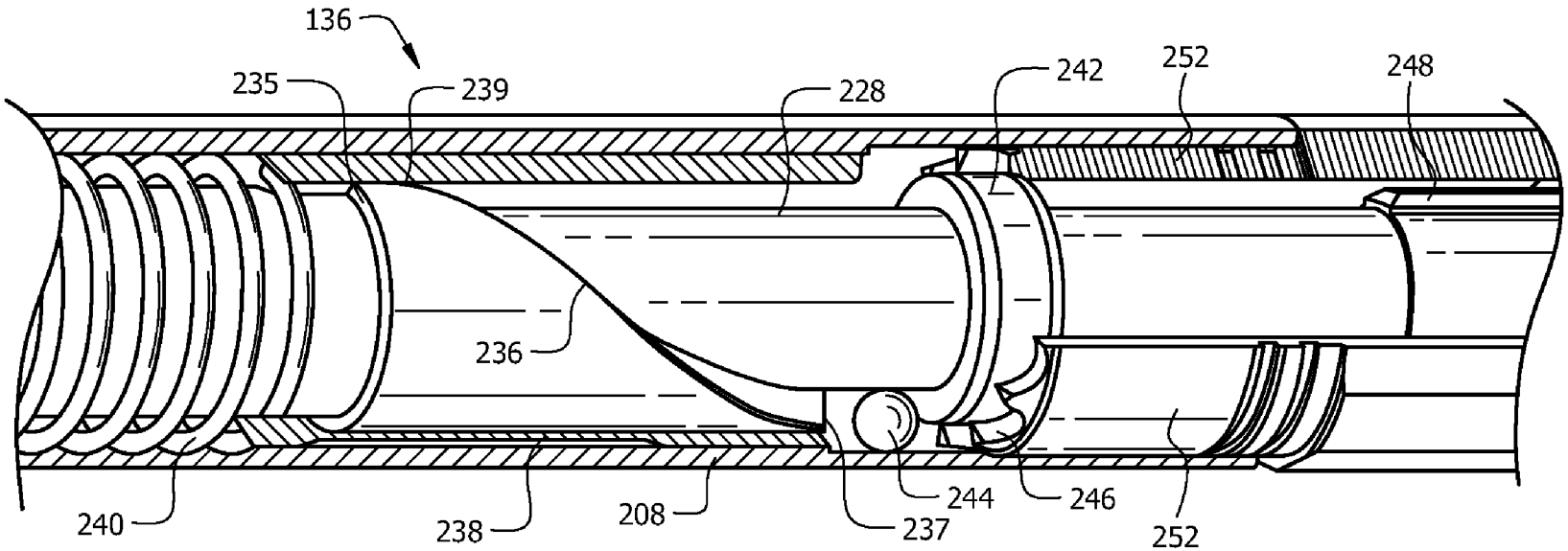
FIG. 10 is an orthogonal cut-away view of the orienting device around the mule shoe mandrel at the beginning of a wellbore servicing operation.

Referring now to FIG. 10, an orthogonal cut-away view of the ball 244 positioned in the position of lowest gravitational potential energy at the beginning of the wellbore servicing method is shown. The ball 244 is freely movable and rotatable within the space between the tapered mule shoe 236, the bottom of the sliding sleeve spring 240, the mule shoe mandrel shoulder 242, the upper housing 208, and the ball notches 246 of the lower housing top 254. At this stage in the method, the sliding sleeve spring 240 is in an expanded position and the tapered mule shoe 236 is in an initial position wherein the tapered mule shoe bottom 237 is adjacent the ball 244.

Figure 11:
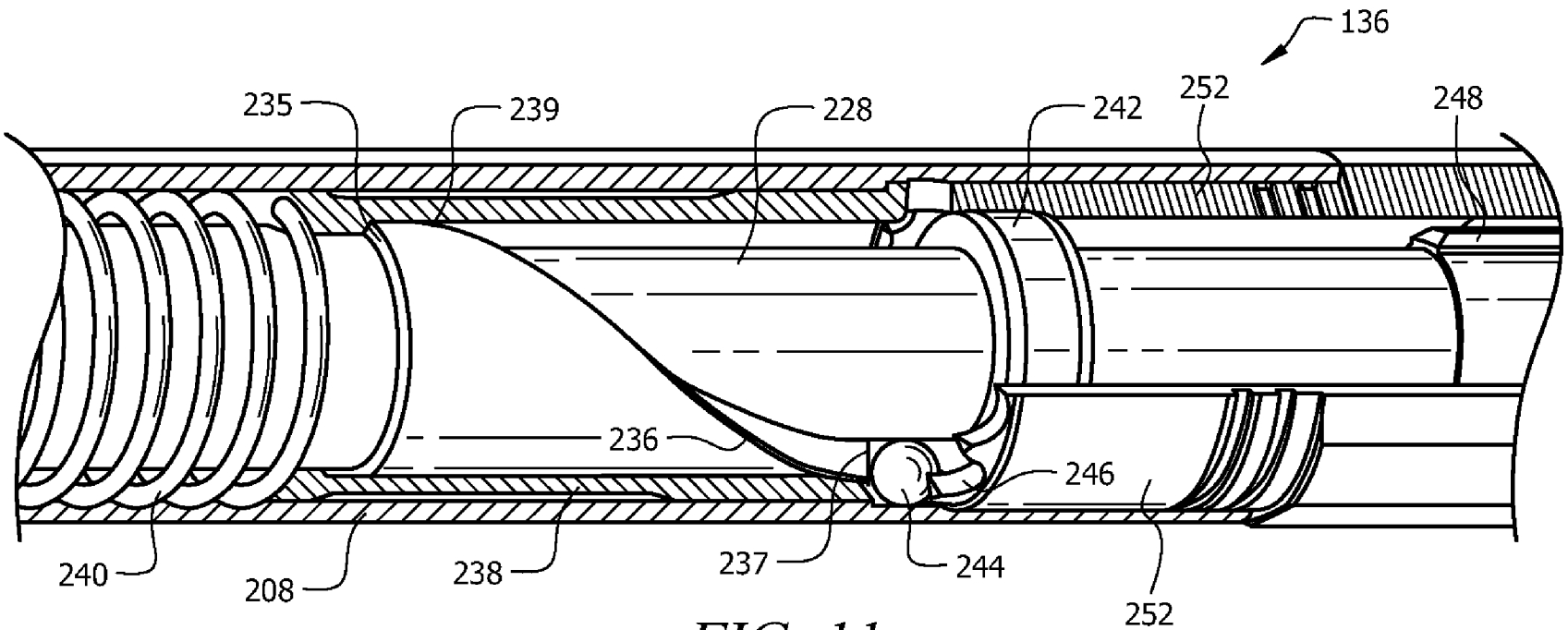
FIG. 11 is an orthogonal cut-away view of the orienting device around the mule shoe mandrel when the ball is received within and is engaged in one of the ball notches.

Referring back to FIG. 9, the wellbore servicing operation begins by flowing a wellbore servicing fluid from the flow passage 132 of the inner string 134 through the orienting device flowbore 137, through the adapter flowbore 139, and to the perforating device flowbore 146, thereby increasing pressure within the first sub 202 of the orienting device 136. The increased pressure moves the piston mandrel 216 longitudinally along the central axis 135 toward the mule shoe mandrel 228 so that the piston mandrel shoulder 222 moves the piston spring 226 until the piston spring 226 contacts the upper housing inside shoulder 213. When the pressure reaches about 700 psi, the piston spring 226 is partially compressed. Continued longitudinal movement of the piston mandrel 216 causes the sliding sleeve spring 240 to compress between the upper housing inside shoulder 213 and the sliding sleeve spring 240. The sliding sleeve spring 240 acts against the sliding sleeve 238 so that the sliding sleeve 238 slides toward and contacts the ball 244, pushing the ball 244 toward the ball notches 246. The ball 244, which was already located in the position of lowest gravitational potential energy, is received within and engages one of the ball notches 246 and is held in the ball notch 246 by the sliding sleeve 238 due to the biased sliding sleeve 238. When the ball 244 is received within and engages one of the ball notches 246, the orientation of the ball 244 with respect to the direction of gravity may slightly change depending of the resolution of the ball notches 246. That way, when the ball 244 is engaged in one of the ball notches 246, the location of the ball 244 may be within about 15°, alternatively within about 5°, alternatively within about 1°, angularly offset from a true position of lowest gravitational potential energy. Of course, alternative embodiments may be configured to provide any acceptable degree of angular offset due to tooth resolution. FIG. 11 is an orthogonal cut-away view of the ball 244 engaged in one of the ball notches 246.

Figure 12:
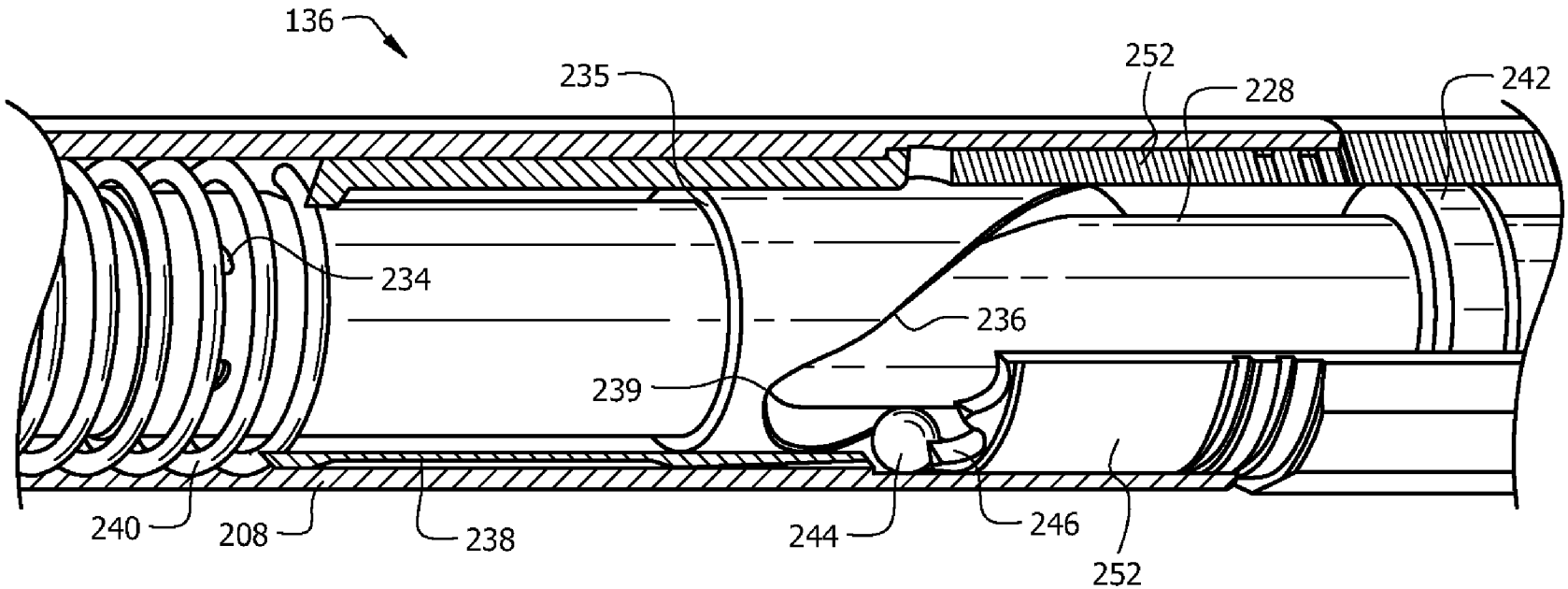
FIG. 12 is an orthogonal cut-away view of the orienting device around the mule shoe mandrel when the tapered mule shoe is partially rotated.

Since the piston mandrel 216 is rigidly connected to the mule shoe mandrel 228, the piston mandrel 216 pushes the mule shoe mandrel 228 toward the swivel mandrel 266 as the piston mandrel 216 moves longitudinally toward the ball 244. This longitudinal movement also causes the tapered mule shoe bottom 237 of the tapered mule shoe 236 to contact the ball 244. When the tapered mule shoe 236 continues to move toward the swivel mandrel 266 and is interfered with by the ball 244, the ball 244 remains substantially stationary and causes the mule shoe mandrel 228 to rotate about the central axis 135 as the mule shoe mandrel 228 continues travelling longitudinally along the central axis 135. During the rotation, the tapered mule shoe 236 of the mule shoe mandrel 228 is pressing against and sliding relative to the ball 244. FIG. 12 is an orthogonal cut-away view of the tapered mule shoe 236 having traveled longitudinally along the central axis 135 and rotationally about the central axis 135.

As the tapered mule shoe 236 moves longitudinally along the central axis 135 toward the swivel mandrel 266 and rotates about the central axis 135, the mule shoe mandrel wings 248 travel longitudinally inside the swivel mandrel wing channels 250 and also rotate about the central axis 135. This causes the swivel mandrel 266 to rotate inside the lower housing 252 relative to the lower housing 252. As the swivel mandrel 266 rotates, the swivel mandrel swivel balls 282 orbit about the central axis 135 between the swivel mandrel swivel tracks 272 and the lower housing swivel tracks 264 allowing the swivel mandrel 266 to rotate about the central axis 135 within the lower housing 252 relative to the lower housing 252.

Further, the second sub 292 rotates as the swivel mandrel 266 rotates, since the swivel mandrel 266 is rigidly connected to the second sub 292 by the interlocking of the swivel mandrel teeth 284 and the second sub teeth 299. The rotation of the second sub 292 causes the adapter 138 to rotate. Since the adapter 138 is rigidly connected to the perforating device 140, the perforating device 140 also rotates. The rotation of the perforating device 140 causes the perforating device apertures 142 and the nozzles 148 to rotate.

Figure 13:
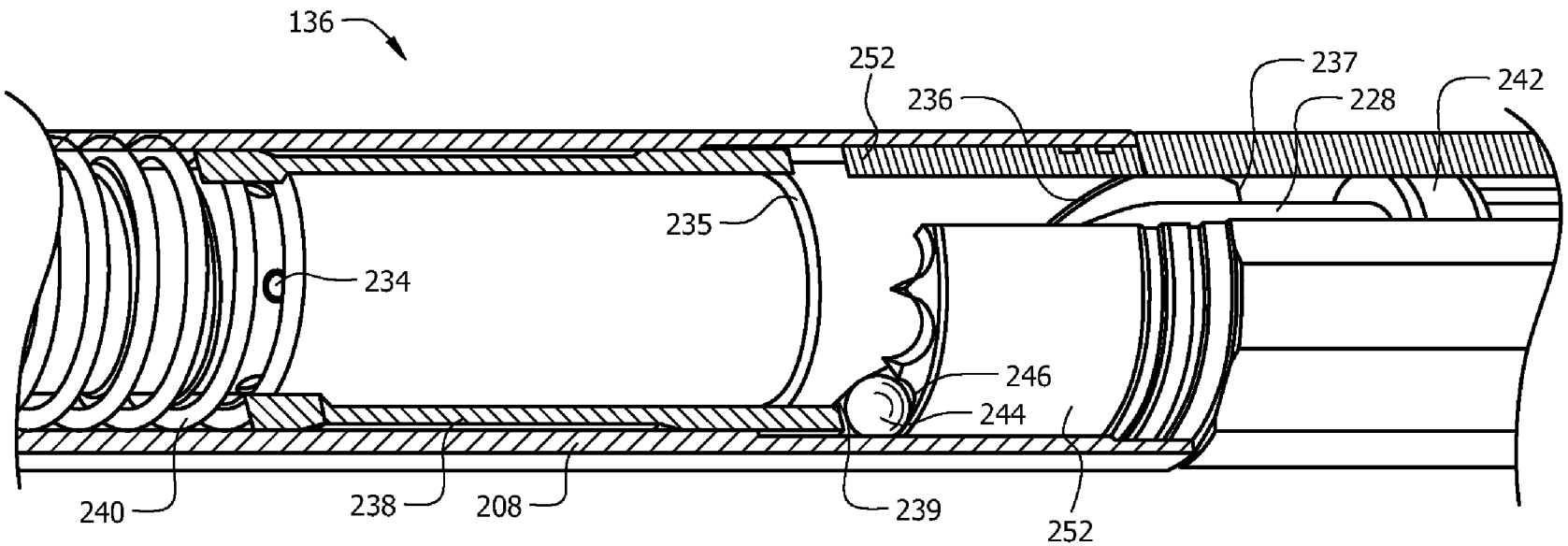
FIG. 13 is an orthogonal cut-away view of the orienting device around the mule shoe mandrel when the tapered mule shoe is completely rotated.

The tapered mule shoe 236 has completed its travel to a maximum longitudinal translation when the tapered mule shoe peak 239 is in contact with the ball 244. At this point, the mule shoe mandrel wings 248 have also completed their travel longitudinally along the swivel mandrel wing channels 250 and rotationally about the central axis 135. Accordingly, the swivel mandrel 266 has rotated the perforating device 140, the nozzles 148, and the perforating device apertures 142 in a selected orientation about the central axis 135 relative to the direction of gravity. FIG. 13 is an orthogonal cross-sectional view of the orienting device 136 wherein the perforating device 140 of FIG. 2 is oriented in a selected orientation relative to the direction of gravity. In this position, the tapered mule shoe peak 239 is contacting the ball 244, which is engaged within one of the ball notches 246. Thus, the orienting device 136 is in an engaged position.

Once the perforating device 140 has been oriented in the selected orientation relative to the direction of gravity about the central axis 135, an abrasive wellbore servicing fluid (such as a fracturing fluid, a particle laden fluid, a cement slurry, etc.) is pumped down the wellbore 114 into the orienting device flowbore 137, through the adapter flowbore 139, through the perforating device flowbore 146, through the perforating nozzles 148, and through the perforating device apertures 142. The abrasive wellbore servicing fluid is pumped down at sufficient flow rate and pressure for a sufficient amount of jetting period to form fluid jets 152. At the end of the jetting period, fluid jets 152 have eroded the formation zone 150 to form perforation tunnels 154 within the formation zone 150. The perforation tunnels 154 are oriented in the selected orientation relative to the direction of gravity about the central axis 135 that leads to the formation of dominant fractures 156, which then lead to the formation of micro-fractures.

In alternative embodiments, an orienting device may be used to orient any other suitable wellbore servicing tools such as a perforating gun. Generally, a perforating gun has a plurality of apertures that allow fluid communication between a perforating gun flowbore and the space exterior to the perforating gun. In that embodiment, at least one aperture of the perforating gun may be oriented at any selected angle relative to the direction of gravity to form perforation tunnels at any angle (e.g., horizontal vertical, 30° angle, etc.). For example, the at least one aperture may be aligned with or selectively angularly offset from a swivel mandrel visual indicator of an orienting device. For example, the at least one aperture may be offset by 30°, 60°, 90°, or 180° with respect to the swivel mandrel visual indicator.

Figure 14:
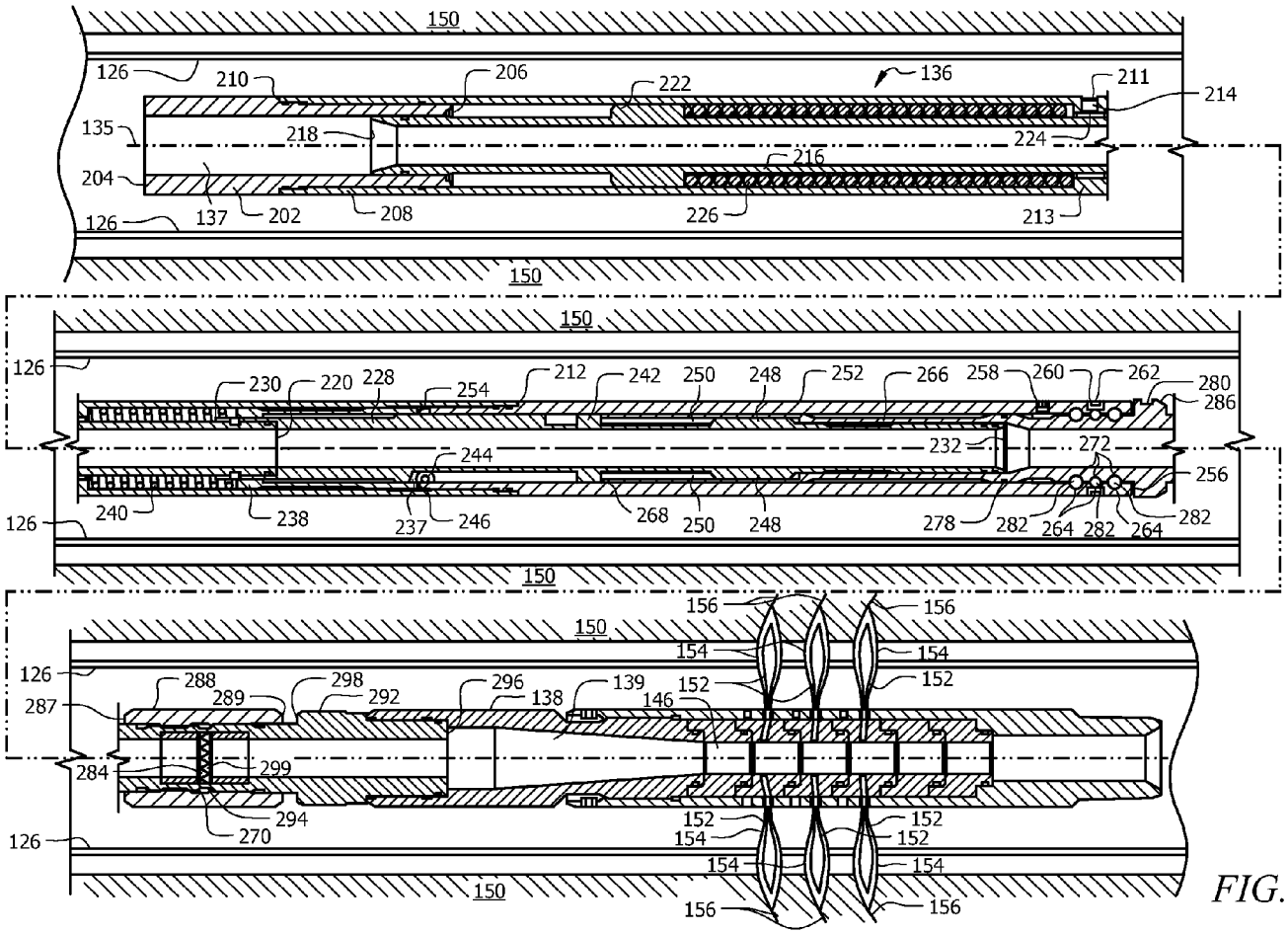
FIG. 14 is an orthogonal cross-sectional view of the orienting device, the adapter, and the perforating device of FIG. 2 during the formation of perforation tunnels and dominant fractures.

Referring now to FIG. 14, a cross-sectional view of the orienting device 136, the adapter 138, and the perforating device 140 during the formation of perforation tunnels 154 and dominant fractures 156 is shown. A wellbore servicing fluid (which may or may not be similar to the abrasive wellbore servicing fluid) is pumped through the perforating device apertures 142 to form dominant fractures 156 in fluid communication with the perforation tunnels 154. The dominant fractures 156 may expand further and form micro-fractures in fluid communication with the dominant fractures 156. Generally, the dominant fractures 156 expand and/or propagate from the perforation tunnels 154 within the formation zone 150 to provide easier passage for production fluid (i.e., hydrocarbon) to the wellbore 114.

It will be appreciated that the orienting device 136 of the wellbore servicing apparatus 100 may be used to repeat orientation of the perforating device 140 or other tools. For example, with the orienting device positioned generally as shown in FIG. 14, to repeat orientation of the perforating device 140, the initial orientation of the perforating device 140 must first be released. The fluid pressure within the first sub 202 must be reduced to release the orientation of the perforating device 140. With sufficient pressure reduction in the first sub 202, the spring force of the piston spring 226 moves the piston mandrel shoulder 222 of piston mandrel 216 toward first sub 202. As the piston mandrel 216 moves, the sliding sleeve spring 240 is allowed to expand and relax within an enlarged space, thereby allowing sliding sleeve 238 to retract away from the ball 244. Further, as mule shoe mandrel shoulder 242 of mule shoe mandrel 228 follows movement of piston mandrel 216 (due to the connection between the piston mandrel 216 and the mule shoe mandrel 228), the mule shoe mandrel shoulder 242 contacts the ball 244 and removes the ball 244 from ball notches 246. It will be appreciated that the lowering of pressure within top sub 202 may be accomplished while the wellbore servicing apparatus 100 is generally stationary along the length of the wellbore 114 and/or may be accomplished as the wellbore servicing apparatus 100 is moved along the length of the wellbore 114.

However accomplished, the lowering of the pressure within top sub 202 results in the ball 244 once again being free to orbit about the central axis 135. With the ball 244 free to orbit about the central axis 135, the ball 244 naturally, due to gravitational forces exerted on the ball 244, orbits to a location of lowest gravitational potential energy. Regardless of where the wellbore servicing apparatus 100 is along the length of the wellbore 114, a subsequent pressurization of the top sub 202 may be caused. Sufficient pressurization of the top sub 202 would initiate operation of orienting device 146 in a manner (described above) that results in orienting the perforating device 140 in a predetermined orientation relative to the direction of gravity. Of course, this depressurization and subsequent pressurization of the first sub 202 may be repeated any number of times and generally results in the repeated orientation of the perforation device 140 to a predetermined orientation relative to the direction of gravity.

The orienting device 136 is one example of a suitable orienting device that uses gravity to find the direction of gravity. In particular, the orienting device 136 uses finding a position of lowest gravitational potential energy to identify the direction of gravity. However, in alternative embodiments, an orienting device may utilize other suitable method to identify the direction of gravity. For example, an orienting device may utilize buoyancy force by using a ball surrounded by liquid or gas to float upward and find the direction of gravity by identifying a position of highest gravitational potential energy. In that embodiment, the orienting device may be utilized in a deviated or horizontal wellbore portion.

Figure 15:
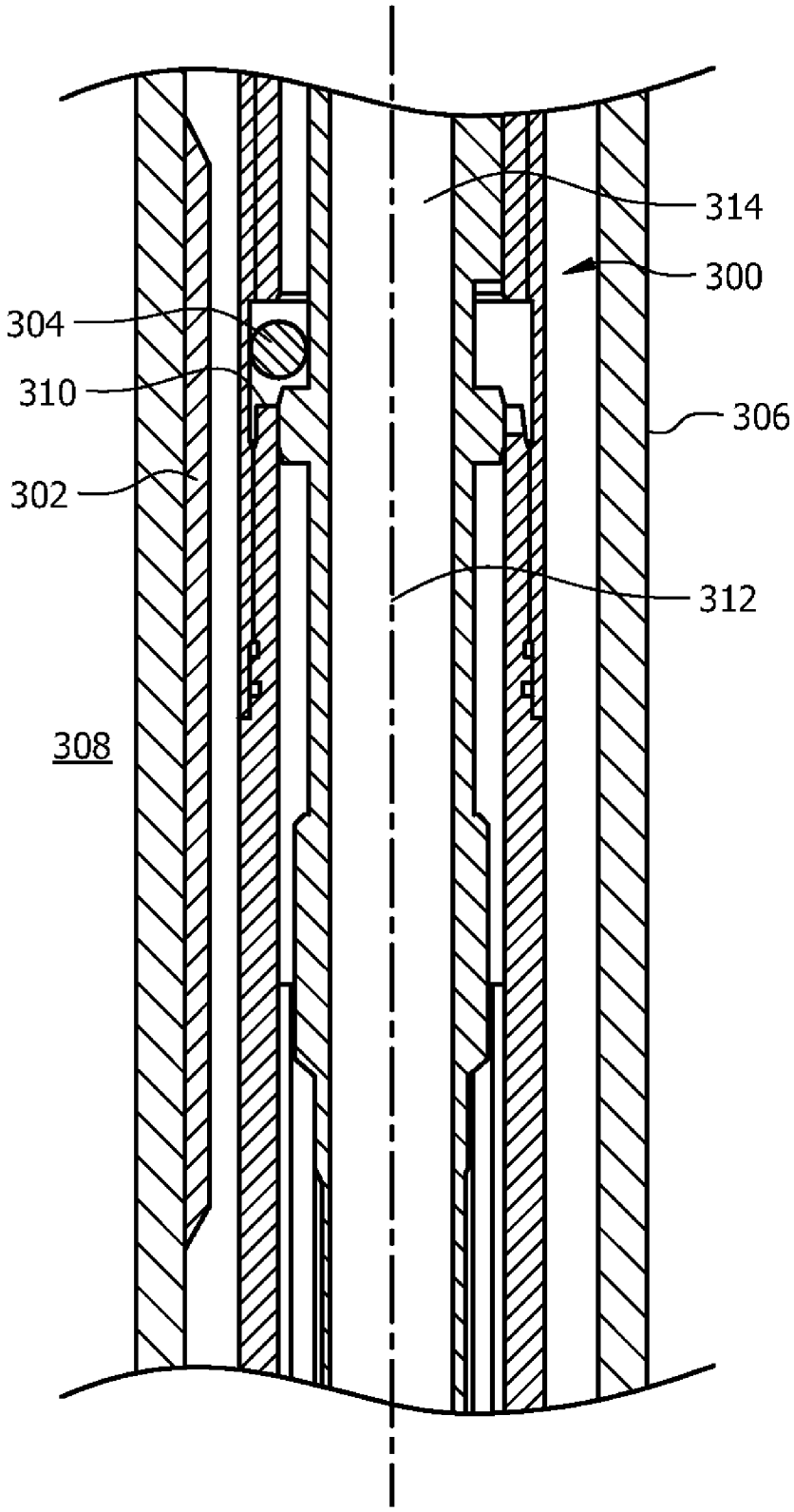
FIG. 15 is an orthogonal cross-sectional view of an alternative embodiment of an orienting device.

Referring now to FIG. 15, an alternative embodiment of an orienting device 300 is shown. The orienting device 300 is substantially similar to the orienting device 136 in form and function except for its method of finding a selected orientation. The orienting device 300 is disposed in a vertical wellbore portion 308, however, in alternative embodiments, an orienting device may be disposed in a deviated or horizontal wellbore portion. The orienting device 300 comprises an orienting device flowbore 314. In this embodiment, the orienting device 300 comprises a ball 304 to find the selected orientation with respect to a magnet 302, as described infra. The orienting device 300 utilizes a magnet 302 that is preinstalled at the selected orientation. The selected orientation is determined by a user and is selected so that identification of the orientation yields information significant to achieving a desired orientation of a tool connected to the orienting device 300. In the orienting device 136, the selected orientation is relative to the direction of gravity. In this embodiment of the orienting device 300, however, the selected orientation is relative to a direction toward of magnetic pull due to the magnet 302. The magnet 302 is positioned on a casing string 306 in a known direction relative to a formation saturated with hydrocarbons (the target formation). The orienting device 300 is connected to an adapter having an adapter flowbore that is in fluid communication with the orienting device flowbore 314. The adapter is connected to a perforating device (or other tool to be oriented) having a perforating device flowbore that is in fluid communication with the adapter flowbore. Typically, as the orienting device 300 is lowered to a formation zone associated with the formation saturated with hydrocarbons, the ball 304 is attracted to and orbits about a central axis 312 to find the location of the magnet 302.

A wellbore servicing operation using the orienting device 300 begins by flowing a wellbore servicing fluid from a flow passage through the orienting device flowbore 314, through the adapter flowbore, and to the perforating device flowbore, thereby applying pressure to the orienting device 300. The pressure moves the components of the orienting device 300, and eventually the ball 304 that was already oriented in the selected direction relative to the magnet 302 is received within and engages one of the ball notches 310 and is held in one of the ball notches 310. In this embodiment, the ball 304 utilizes the magnet 302 to find the selected orientation. The orienting device 300 then rotates a perforating device about the central axis 312 to the selected orientation in a manner substantially similar to that described above with respect to wellbore servicing apparatus 100.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore servicing apparatus, comprising:

a first mandrel movable longitudinally along a central axis and rotatable about the central axis;

an orienting member configured to selectively interfere with movement of the first mandrel along the central axis, wherein the first mandrel comprises a tapered mule shoe that selectively contacts the orienting member so that as the first mandrel is moved longitudinally toward the orienting member, the tapered mule shoe slides along the orienting member; and a second mandrel connected to the first mandrel and configured to rotate about the central axis when the first mandrel rotates about the central axis.

2. The wellbore servicing apparatus according to claim 1, wherein the orienting member is a ball.

3. The wellbore servicing apparatus according to claim 1, wherein the second mandrel is configured to remain substantially stationary longitudinally along the central axis.

4. The wellbore servicing apparatus according to claim 1, wherein the orienting member selectively orbits about the central axis.

5. The wellbore servicing apparatus according to claim 1, wherein the orienting member is selectively secured in a position of lowest gravitational potential energy.

6. The wellbore servicing apparatus according to claim 1, further comprising:

a first housing that houses the second mandrel, the first housing comprising notches for receiving the orienting member.

7. The wellbore servicing apparatus according to claim 1, wherein the first mandrel comprises a wing that is slidingly received within a channel of the second mandrel.

8. The wellbore servicing apparatus according to claim 1, wherein the first mandrel is configured to move longitudinally along the central axis in response to a pressure.

9. A method of orienting a wellbore servicing tool, comprising:

connecting an orienting tool to the wellbore servicing tool;

identifying a predetermined direction;

increasing a pressure within the orienting tool;

rotating a portion of the orienting tool in response to the increase in pressure within the orienting tool;

rotating the wellbore servicing tool in response to the rotating of the portion of the orienting tool; and further comprising:

after rotating the wellbore servicing tool in response to the rotating of the portion of the orienting tool, sufficiently reducing the pressure within the orienting tool to discontinue identifying the predetermined direction; and increasing the pressure within the orienting tool to repeat the identifying of the predetermined direction.

10. The method according to claim 9, wherein the predetermined direction is a direction of gravity.

11. The method according to claim 9, wherein the predetermined direction is a direction associated with a magnetic force.

12. The method according to claim 9, wherein the identifying of the predetermined direction is accomplished by identifying a position of lowest gravitational potential energy.

13. The method according to claim 9, wherein the identifying of the predetermined direction is accomplished by locating an orienting member in a position of lowest gravitational potential energy.

14. The method according to claim 9, wherein the identifying of the predetermined direction is accomplished by locating an orienting member in a position nearest a magnet.

15. The method according to claim 13, wherein an amount of rotation of the portion of the orienting tool is dependent upon the position of an orienting member relative to a position of lowest gravitational potential energy.

16. A wellbore servicing apparatus, comprising:

a first mandrel movable longitudinally along a central axis and rotatable about the central axis;

an orienting member configured to selectively interfere with movement of the first mandrel along the central axis;

a second mandrel connected to the first mandrel and configured to rotate about the central axis when the first mandrel rotates about the central axis; and a first housing that houses the second mandrel, the first housing comprising notches for receiving the orienting member.

17. The wellbore servicing apparatus according to claim 16, wherein the orienting member is a ball.

18. The wellbore servicing apparatus according to claim 16, wherein the second mandrel is configured to remain substantially stationary longitudinally along the central axis.

19. The wellbore servicing apparatus according to claim 16, wherein the orienting member selectively orbits about the central axis.

20. The wellbore servicing apparatus according to claim 16, wherein the orienting member is selectively secured in a position of lowest gravitational potential energy.

21. The wellbore servicing apparatus according to claim 16, wherein the first mandrel comprises a wing that is slidingly received within a channel of the second mandrel.

22. The wellbore servicing apparatus according to claim 16, wherein the first mandrel is configured to move longitudinally along the central axis in response to a pressure.

* * * * *